United States Patent [19]

Miki et al.

[11] 4,223,718

[45] Sep. 23, 1980

[54] MOLTEN METAL INJECTION DEVICE FOR DIE CASTING MACHINE

[76] Inventors: Isao Miki, 1288-1 Kusanagi, Shimizu-shi, Shizuoka-ken; Takeshi Kido, 977 Tadehara, Fuji-shi, Shizuoka-ken; Keiichi Kokubun, 2-1-2 Fujigaoka, Yokohama-shi, Kanagawa-ken, all of Japan

[21] Appl. No.: 6,637

[22] Filed: Jan. 26, 1979

Related U.S. Application Data

[63] Continuation of Ser. No. 613,342, Sep. 15, 1975, abandoned.

[51] Int. Cl.[3] ..... B22D 17/10

[52] U.S. Cl. ..... 164/149; 164/158; 164/314; 425/107; 15/405

[58] Field of Search ..... 164/120, 149, 158, 312–315, 164/321; 425/107; 184/5, 18, 24; 134/198; 15/316 R, 405, 406

[56] References Cited

U.S. PATENT DOCUMENTS

| | | | |
|---|---|---|---|
| 1,957,439 | 5/1934 | Bednash | 15/406 X |
| 2,066,521 | 1/1937 | Dailey | 164/120 X |
| 2,272,686 | 2/1942 | McGibbon | 15/316 R X |
| 2,814,083 | 11/1957 | Beyer | 164/158 |
| 3,172,174 | 3/1965 | Johnson | 164/315 X |
| 3,209,416 | 10/1965 | Morton | 164/149 |
| 3,349,835 | 10/1967 | Müller | 164/158 |
| 3,544,355 | 12/1970 | Ott | 164/312 X |
| 3,767,012 | 10/1973 | Jimi et al. | 425/107 X |

FOREIGN PATENT DOCUMENTS

| | | | |
|---|---|---|---|
| 1410361 | 8/1965 | France . | |
| 1489346 | 6/1967 | France . | |
| 924494 | 4/1963 | United Kingdom | 164/312 |
| 981654 | 1/1965 | United Kingdom | 164/312 |

*Primary Examiner*—Robert D. Baldwin
*Assistant Examiner*—J. Reed Batten, Jr.
*Attorney, Agent, or Firm*—Brumbaugh, Graves, Donohue & Raymond

[57] ABSTRACT

A molten metal injecting device for a cold chamber type die casting machine wherein a cavity is provided in which a metal cast body is formed between a movable die and a stationary die. Molten metal in an injection sleeve is injected into the cavity by a piston through a narrow gate. The sleeve has a feeding port for introducing the molten metal. An opening is provided in the sleeve in which the piston on the end of the plunger is exposed partially between the feeding port of the sleeve and the inserting end of the plunger. Lubricant spraying nozzles and compressed air blowing nozzles are arranged towards the opening, and a mechanism is provided for rotating the piston.

4 Claims, 6 Drawing Figures

MOLTEN METAL INJECTION DEVICE FOR DIE CASTING MACHINE

This is a continuation of application Ser. No. 613,342, filed Sept. 15, 1975, now abandoned.

The present invention relates to an improvement in a molten metal injecting device of a cold chamber type die casting machine, and more particularly the invention is directed to obtaining a smoothly operating molten metal injecting operation by improving the mode of application of lubricant for the piston of the injection molding machine, as well as by performing easy cleaning of deposited metal on the piston surface.

In a die casting machine of the cold chamber type, casting is effected by feeding a molten metal into an injection sleeve which communicates with the die casting cavity, and then by injecting under pressure the molten metal into the die cavity by a plunger, with a piston at one end which reciprocates in said sleeve. In such a molten metal injection device, it has been usual to lubricate the sliding portions of the plunger and the sleeve, that is, at the piston, for smooth operation of the casting operation, and at the same time to prevent abrasion of the surfaces of the apparatus. Heretofore, however, in apparatus of this kind, the piston is always concealed in the sleeve so that in general it is extremely difficult to lubricate the piston, and the lubrication which was performed had to rely upon a mode of application such that the lubricant deposited on another part of the apparatus was caused to be transferred at the piston indirectly by the reciprocating motion of the plunger. Accordingly, the application of the lubricant could not be effected uniformly and therefore a sufficient lubricating effect could not be obtained. Moreover, it has been impossible to avoid the adherence of metal on the surface of the piston which is introduced into the small clearance between the sleeve and the piston when injecting the molten metal, and this adherence of metal is particularly noticeable on all the periphery near the end of the piston. The cleaning and removal of such metal adhered to the piston surface has been quite difficult.

When the casting operation is continued without proper lubrication and removal of the adhered metal or without complete removal of the adhered metal, the smooth movement of the injection device has not been obtained, with the result of the casting of defective articles. Moreover, the service life of the injection device has been shortened.

The object of the present invention is to eliminate the disadvantages of the conventional device for injection of molten metal in die casting machines, and to obtain smooth and effective molten metal injection.

Another object of the invention is to provide improved molten metal injection with a perfect and uniform application of lubricant onto the surface of the piston.

Still another object of the invention is to provide the molten metal injection device with means for performing easy and complete cleaning of adhered metal on the surface of the piston while the casting operation is in progress.

The improved molten metal injection device of the present invention will now be described while making reference to the accompanying drawings wherein FIG. 1 is a longitudinal view partly in section of a cold chamber type die casting device which is provided with a sleeve according to the present invention;

Figure 1:
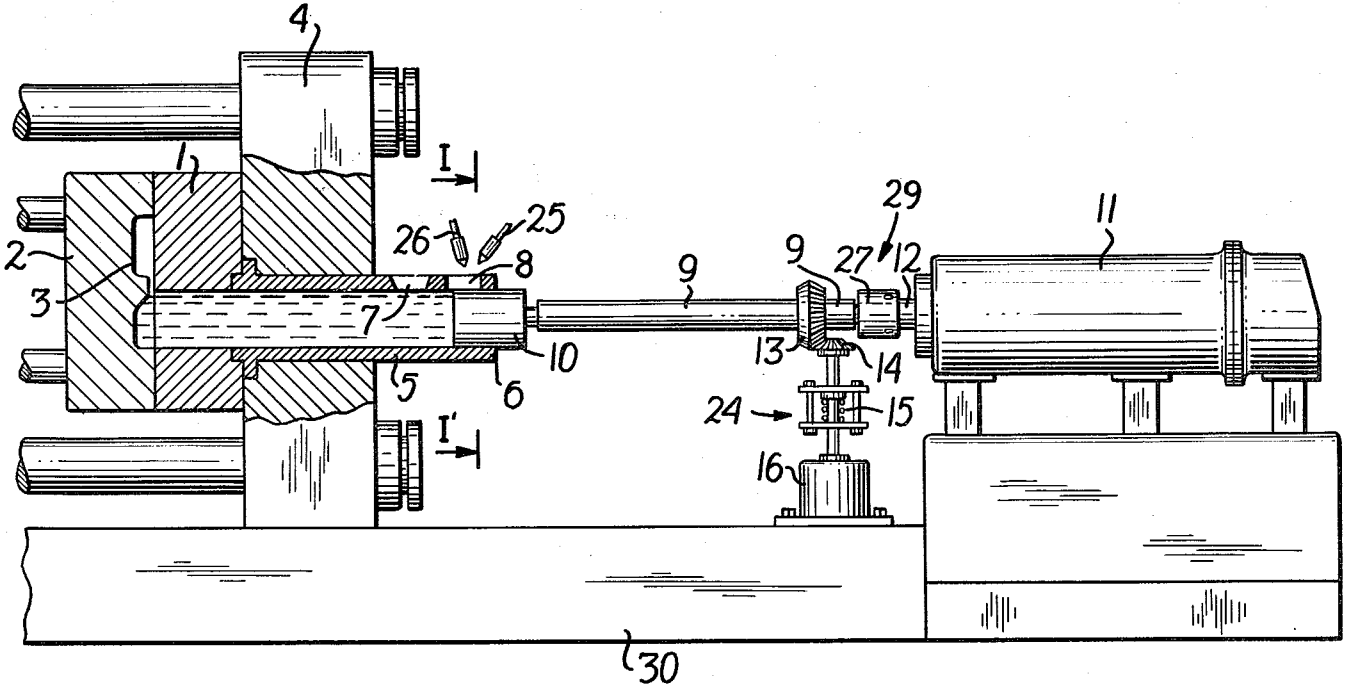

As shown in FIG. 1, an injection sleeve 5 is mounted on a stationary platen 4 which is fixed with each of a stationary die 1 and a movable die 2 to inject molten metal under pressure into a cavity 3 which is formed between said dies 1 and 2. On the upper side of this injection sleeve 5 there is provided a feeding port 7 for feeding molten metal into the sleeve 5, and a piston 10 provided at the forward end of the plunger 9 is inserted into the sleeve 5. Thus, the molten metal is injected under pressure into the cavity 3 by the reciprocating movement of the plunger 9, which reciprocating movement is provided by a hydraulic driving unit 11, which includes an actuating piston 12. The numeral 30 indicates a bed or foundation on which the die casting machine is mounted.

According to the present invention, a coupling mechanism 29 is provided for rotation of the plunger 9 at the coupling portion of the plunger 9 and the actuating piston 12, and further an opening 8 is formed in the sleeve 5 between the molten metal feeding port 7 and the inserting end 6 of the plunger to expose partly the piston 10 when the piston 10 in the sleeve 5 assumes its withdrawn position. Lubricant spraying nozzles 25 and compressed air blowing nozzles 26 are arranged as shown and pointed towards the opening 8 of the sleeve 5. The numeral 24 indicates a rotating mechanism for the plunger 9.

The rotating mechanism 24 is actuated by engaging a bevel gear 13 mounted near the rear end portion of the plunger 9 with a driving bevel gear 14 mounted on the foundation 30. The numeral 15 shows an engaging adjuster provided on a shaft of the driving bevel gear 14 for facilitating the engagement of both of the bevel gears 13 and 14.

A motor 16 is provided for rotating the driving bevel gear.

Figure 2:
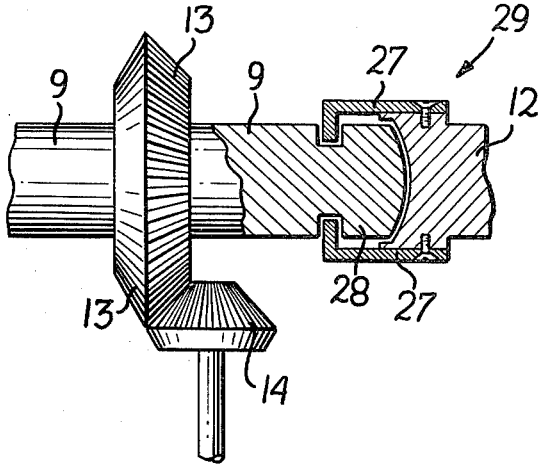
FIG. 2 is a vertical sectional view of a coupling connecting the rear end of the plunger and the actuation piston.

The coupling mechanism 29 provided at the coupling portion of the plunger 9 and the actuating piston 12 are shown in FIG. 2, wherein the numeral 27 designates a coupling cover, 28 designates a rear portion of the plunger formed into a convexed surface which mates with the corresponding concave surface of the actuating piston 12. It will also be noted that the plunger 9 is held rotatably by said concave surface and the coupling cover 27. By operating the motor 16 to rotate the driving bevel gear 14, the plunger 9 can be rotated through the bevel gear 13 engaging the bevel gear 14.

As for the rotating mechanism 24, it is not limited to the bevel gears shown and described above, but it may be a pinion and rack system, a lever arm and spring system, or any other appropriate rotating mechanism.

Figure 5:
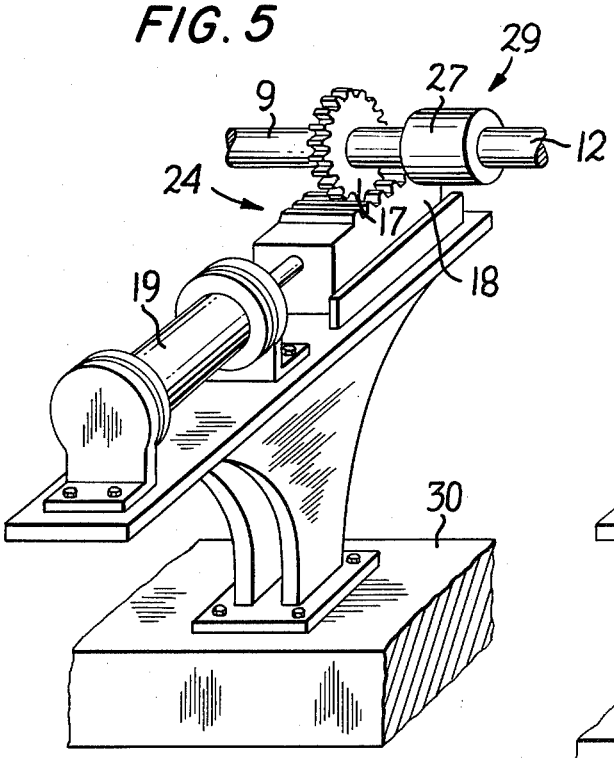
FIGS. 5 and 6 show perspective views of another embodiment of the plunger rotating mechanism.

FIG. 5 is a rotating mechanism of the pinion-rack type. The numeral 17 shows a pinion provided on the plunger 9. The numeral 18 shows a rack engaging with said pinion 17. The rack 18 makes forward and backward motions by means of a pusher 19 which was provided on the foundation 30 of the die casting machine.

Figure 6:
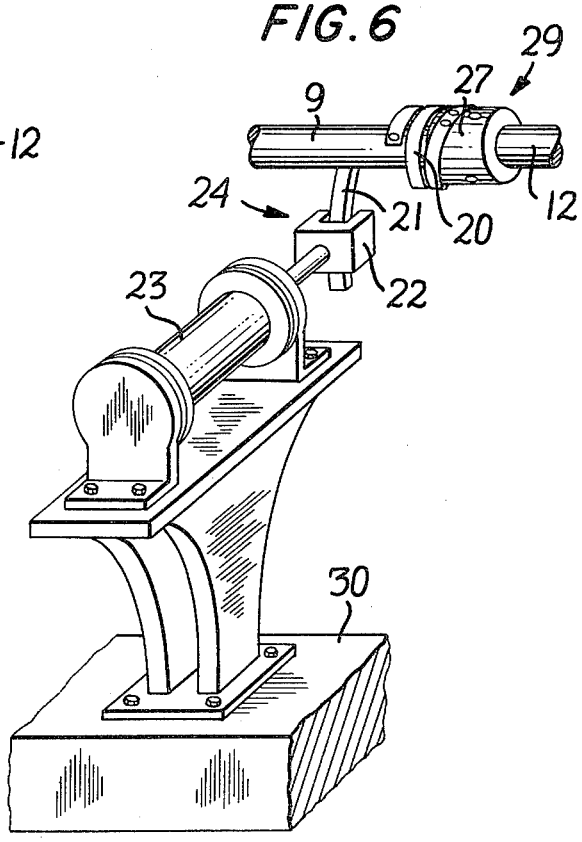

FIG. 6 shows a rotating mechanism of a lever arm-spring type. The numeral 20 in the drawing shows a spring, both ends of which are secured onto a coupling cover 27 and the rear portion of the plunger 9, and the numeral 21 designates a lever arm projectingly provided near the rear end of the plunger.

The numeral 23 designates a pusher provided with a pusher head 22 at the tip end, and the lever arm 21 is pushed forward by the pusher head 22 upon forward movement of the pusher 23, and the plunger 9 is thereby rotated.

When the pusher 23 is withdrawn, the plunger 9 reassumes its original position by the action of the spring 20.

Figure 3:
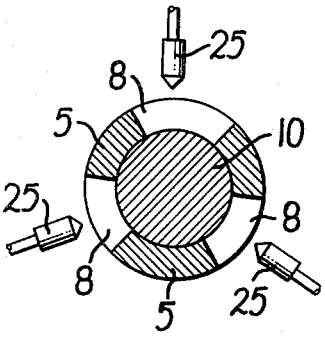
FIGS. 3 and 4 are sectional views through a line I—I' showing openings according to the present invention.
Figure 4:
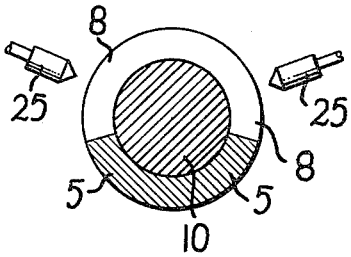

FIGS. 3 and 4 show sectional views through a line I—I' at the opening 8. The openings 8 may be provided in plural number at the periphery of the sleeve as shown in FIG. 3, or a single opening having relatively large dimension as shown in FIG. 4 may also be provided.

According to the present invention, the shape, size and position of the opening 8 are not limited to those which are shown in the drawings.

The process of injection molding of the molten metal using the device according to the present invention will now be described, referring to FIG. 1.

Molten metal is introduced into the sleeve 5 through the feeding port 7. The actuating piston 12 is then operated to advance the plunger 9 such that the molten metal in the sleeve 5 is injected under pressure into the cavity 3. After the injected molten metal has been solidified, the piston 10 is withdrawn together with the withdrawal of the plunger 9, and the piston reaches the position between the feeding port 7 and the insert end 6 of the piston 10. At that moment, the bevel gear 13 engages the driving bevel gear 14. After such engagement of the bevel gears, the motor 16 is rotated thereby rotating the driving bevel gear 14, and with the rotation of the bevel gear 13, the piston is rotated.

When the piston 10 is started to be rotated, compressed air is blown through the compressed air blowing nozzles 26, whereby metal which may have adhered to the surface of the piston 10 is removed and the piston 10 is cleaned. Next, lubricant is sprayed from the lubricant spraying nozzles 25 so as to apply the lubricant onto the surface of the piston 10.

In this way, by carrying out the blowing of compressed air and the spraying of a lubricant, the metal which may have adhered onto the surface of the piston 10 is removed and the piston is cleaned perfectly, and also the application of the lubricant is effected uniformly over the entire peripheral surface of the piston. This is so because the entire surface of the piston 10 has been exposed through the opening 8.

The rotation of the plunger 9, the blowing of the compressed air and the spraying of the lubricant can be actuated automatically by means of a limit switch mechanism (not shown) or the like.

As stated above, in accordance with the present invention, it is possible to apply the lubricant positively on all the peripheral surfaces of the piston 10, and also to clean the metal which may have adhered on the piston 10 perfectly, so that the injection operation in the die casting machine is carried out smoothly so as to produce products having excellent quality. Furthermore, since it is possible to inject the molten metal after giving the plunger a certain angle of rotation for each shot, or an appropriate number of shots, the contacting surface of the piston 10 with the sleeve 5 is not particularized, so that the abrasion and wear is balanced. In this way the difficulties due to unavoidable abrasion and wear and the frequency of replacement of parts can be reduced, so that a smooth injection operation is obtained together with a considerable increase in the service life of the apparatus.

We claim:

1. In a molten metal injection device for a cold chamber type die casting machine, wherein a cavity is provided in which a metal cast body is formed between a movable die and a stationary die, and molten metal is injected by a reciprocatable piston through an injection sleeve into said cavity through a narrow gate, said sleeve having an inserting end for said piston and an oppositely disposed gate end and having a feeding port for said molten metal, the improvement which comprises at least one open aperture provided in said sleeve between said feeding port and said inserting end in which the sliding surface of said piston is partially exposed when near said inserting end, first nozzle means arranged for spraying lubricant through said aperture onto at least the forward portion of said exposed surface of said piston, and second nozzle means arranged for directing compressed air through said aperture onto said exposed surface of said piston at sufficient pressure for removing adhered metal deposits from said exposed surface.

2. Apparatus according to claim 1, wherein said sleeve has a plurality of apertures spaced radially therearound between said feeding port and said inserting end, and includes a first set of nozzles for spraying lubricant through each said aperture onto said exposed surface of said piston, and a second set of nozzles for directing compressed air through each said aperture onto said exposed surface of said piston for cleaning said exposed surface.

3. Apparatus according to claim 1, including also means for rotating said piston on its longitudinal axis.

4. Apparatus according to claim 3, wherein said rotating means is adapted to rotate said piston through an angle sufficient to expose the entire sliding surface through said aperture.

* * * * *